United States Patent [19]

Jelling et al.

[11] 4,027,461

[45] June 7, 1977

[54] FLOATING HOOK ARRANGEMENT FOR AN APPARATUS FOR BAGGING GARMENTS

[75] Inventors: Murray Jelling, Roslyn Heights; Alexander Kahn, Massapequa; Ernest George Moore, East Meadow; Michael Friedman, Brooklyn, all of N.Y.

[73] Assignee: U.S. Dynamics Corporation, Amityville, N.Y. ; a part interest

[22] Filed: July 22, 1976

[21] Appl. No.: 707,653

[52] U.S. Cl. ..... 53/241

[51] Int. Cl.[2] ..... B65B 43/26; B65B 67/04

[58] Field of Search ..... 53/241, 256

[56] References Cited

UNITED STATES PATENTS 2,590,742 3/1952 Williams ..... 53/241

*Primary Examiner*—Travis S. McGehee

*Attorney, Agent, or Firm*—Roberts & Cohen

[57] ABSTRACT

An elongated central shaft is provided at one end with a hook for supporting thereon a hanger for a garment. The other end of the central elongated shaft is connected to a mounting element which mounts the arrangement on an apparatus for bagging garments. The elongated shaft has mounted thereabout a compressible spreader unit which is hinged at its ends so that, as a bag is pulled down from an apparatus for bagging garments, the spreader unit positioned about the central elongated shaft will cause the bag to open and avoid contact with the hook and the central elongated shaft.

13 Claims, 4 Drawing Figures

III
III
IV
IV
56
62
60
68
64
42
40
38
100
100
46
50
90
88
80
82
30
110
86
94
84
92
24
32
112
34
114
36

FLOATING HOOK ARRANGEMENT FOR AN APPARATUS FOR BAGGING GARMENTS

FIELD OF THE INVENTION

This invention relates to an apparatus for dispensing bags arranged in a continuous series, and more particularly to a floating hook arrangement for such apparatus.

BACKGROUND OF THE INVENTION

In U.S. Pat. No. 3,961,460, there is disclosed a bagging apparatus for dispensing polyethylene bags or the like arranged in a continuous series over garments hanging from a floating hook arrangement in the apparatus. In said co-pending application, a roll of the polyethylene bags is rotatably supported on the apparatus and the bags are fed to a dispensing device arranged directly above an appropriately supported garment which is to be bagged. The roll of polyethylene bags is provided in a form in which flatted tubing is separated by a series of transverse tear lines which form the separating lines between individual bags. The section of the flatted tubing directly behind the tear line constitutes the mouth or open leading end of one bag, while that section directly in front of the tear line constitutes the trailing or closed end of the next preceding bag. The closed end is achieved by providing a plurality of seams on the tubing. When the bag is pulled down over a garment at the dispensing station, the seams contact the upper portion of the garment and support the bag in surrounding relationship relative to the garment.

The dispensing station of the known apparatus, in which is located a hung garment, is provided with a pair of spreaders which enter into the leading or open end of each bag in order to open the leading end for subsequent placement over the garment. The spreaders enter into the leading end of each bag after the preceding bag has been pulled down over a garment to be bagged so as to set up the next bagging process for a different garment which is substituted at the dispensing station.

The known apparatus is also provided with a sensing device which senses when a bag has been pulled over a garment. The sensing device controls a braking device activation of which prevents the longitudinal movement of the flatted tubing and thereby allows for the tearing away of the bag draped about the garment at the tear line between it and the trailing bag.

The garment which is to be bagged is hung by a hanger from a floating hook arrangement of the apparatus. Therefore, in order for the bag which is to be draped about the garment to pass by both the spreaders and the floating hook arrangement, the seams constituting the trailing or closed end of each bag have openings therein. These openings are of sufficient width that the two spreaders and the floating hook arrangement can pass therethrough without interference upon the pulling of the associated bag over the garment and can enter into the leading or open end of the next sequential bag.

The floating hook arrangement of the said U.S. Pat. No 3,961,460 is positioned midway between the pair of spreaders, with only the spreaders serving to open up the leading ends of the respective bags. The two spreaders enter the leading end of each bag at the extremities thereof and, as a consequence, it is possible that the center of the bag may not open wide enough to permit complete clearance of the floating hook arrangement, thereby resulting in the plastic bag's being caught at the center thereof on the floating hook arrangement.

Attention may also be directed to related structures shown in U.S. Pat. Nos. 3,181,773; 3,287,881 and 3,308,601 as well as to prior art patents cited therein.

SUMMARY OF THE INVENTION

It is a general object of the invention to provide an improved bagging apparatus.

It is another object of the present invention to provide an improved floating hook arrangement for use in an apparatus for bagging garments, which improved floating hook arrangement aids in preventing plastic bags used for bagging garments and the like from catching on any portion of the floating hook arrangement.

To achieve the above and other objects of the invention, a floating hook arrangement is provided which comprises in one specific form thereof a central elongated shaft at one end of which is mounted a hook for supporting a hanger having a garment to be bagged thereon. The other end of the central elongated shaft is connected to a mounting means which mounts the arrangement in the bagging apparatus. A feature of the invention lies in the provision of a spreader unit positioned about the central elongated shaft and connected at one end to the mounting means for the floating hook arrangement and at the other end to a slide movable along the central elongated shaft. The spreader unit is made up of a pair of curved spring steel sheets each of which is bent to form an upper angled portion and a lower angled portion. One end of each lower angled portion is connected to the slide, while one end of each upper angled portion is connected to the mounting means for the floating hook arrangement.

The ends of the angled portions are connected to their respective supports by rolled ends which are received in hinge sockets in such a manner that the rolled ends may partially turn within the hinge sockets and thereby allow a greater flexibility and concomitant longer life of the spreader unit.

The arrangement of the invention may be used in combination with spreaders existent in known bagging apparatus or, alternatively, can be used in an apparatus not utilizing any other spreaders at all.

Viewed in another sense, the invention provides an apparatus comprising first means for detachably engaging a unit to be processed such as a garment on a hanger, there being furthermore provided a support and second means for connecting the first means to said support in spaced relation thereto. The first and second means are generally longitudinal alignment and have respective maximum transverse dimensions relative to this alignment. In accordance with the invention, there is provided a compressible means extending transversely of said second means and having a normal expanded dimension exceeding the respective maximum transverse dimensions of the first means support and second means, but being compressible to enable passage through a restricted opening. The compressible means in normal expanded state is adapted to perform a spreading function. It extends outwardly from opposite sides of the second means in the preferred embodiment thereof.

BRIEF DESCRIPTION OF THE DRAWING

The invention will be more readily understood with reference to the following detailed description, when taken in conjunction with the accompanying drawing wherein.

DETAILED DESCRIPTION OF THE INVENTION

Figure 1:
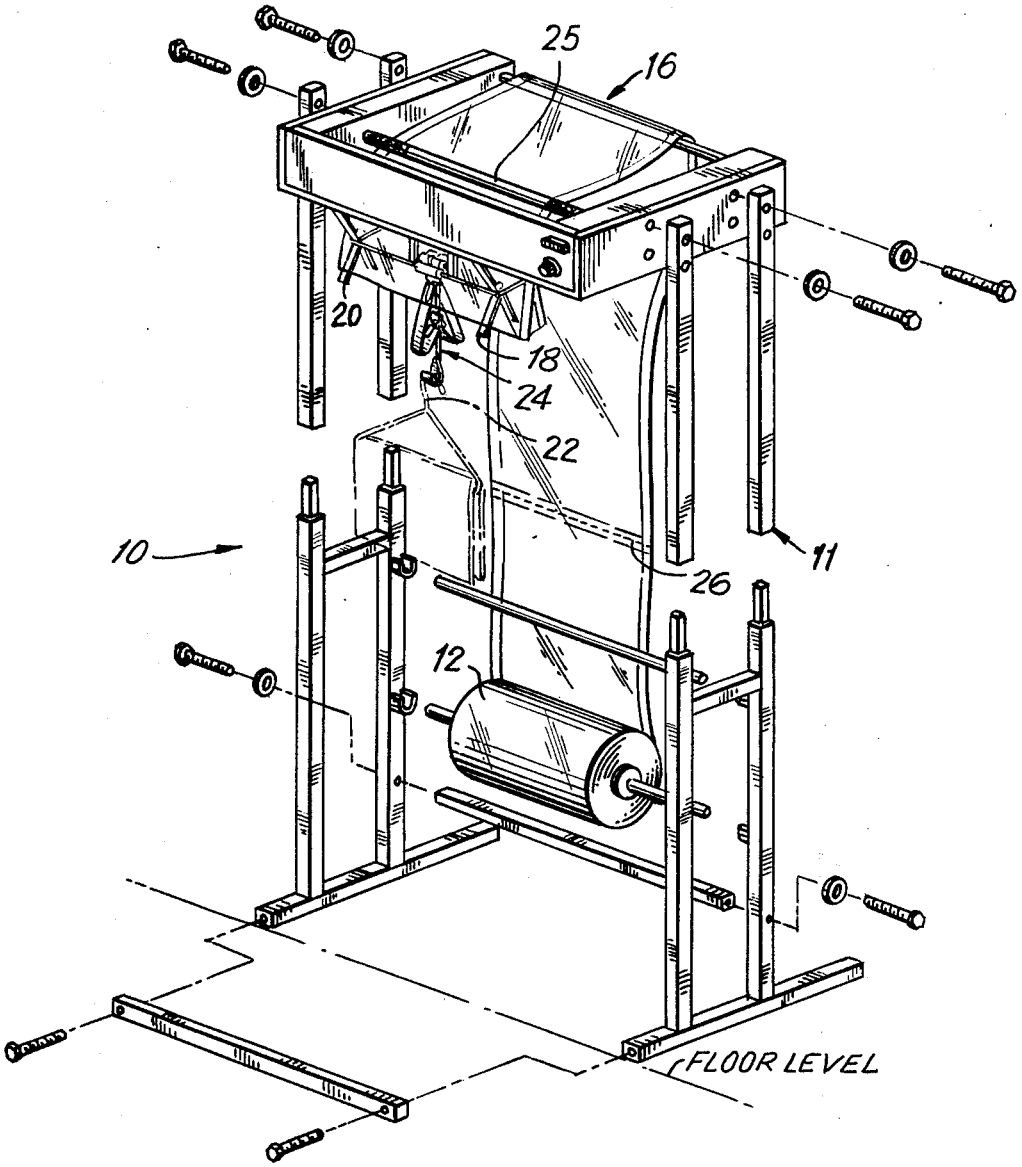
FIG. 1 is an exploded perspective view of a bagging apparatus incorporating therein the floating hook arrangement of the present invention.

Referring now the drawing, and particularly to FIG. 1, there is shown an apparatus for bagging garments incorporating therein the floating hook arrangement of the present invention. It is to be noted that the apparatus for bagging garments shown in FIG. 1 is the same as that disclosed in U.S. Pat. No. 3,961,460 except that the floating hook arrangement of the present invention has replaced the floating hook arrangement used in said prior application.

The apparatus for bagging garments is generally indicated by reference numeral 10 in FIG. 1, and, as disclosed in U.S. Pat. No. 3,961,460 it comprises a support section rotatably accommodating a supply of plastic bags 12. The support section 11 has at the top thereof the dispensing section of the apparatus which is generally shown at 16.

The dispensing 16 optionally has therein a pair of spreaders 18 and 20 which enter into the leading open end of each bag being moved inot position and thereby open each such bag for subsequent pulling over a garment. The garment is supported by a hanger 22 on the floating hook arrangement 24 of the invention.

The dispensing section also includes therein a sensing device (not shown) and a braking device 25 which provide for tearing away of a leading bag from the rest of the sequence of bags along a tear line 26 which defines the boundary between the trailing edge of the forwardmost bag and the leading open end of the bag immediately therebehind. As explained above, the trailing end of each bag is closed off by means of seams which may have openings dimesioned to allow for the passage therethrough of the spreaders 18 and 20 and the floating hook arrangement 24.

Figure 2:
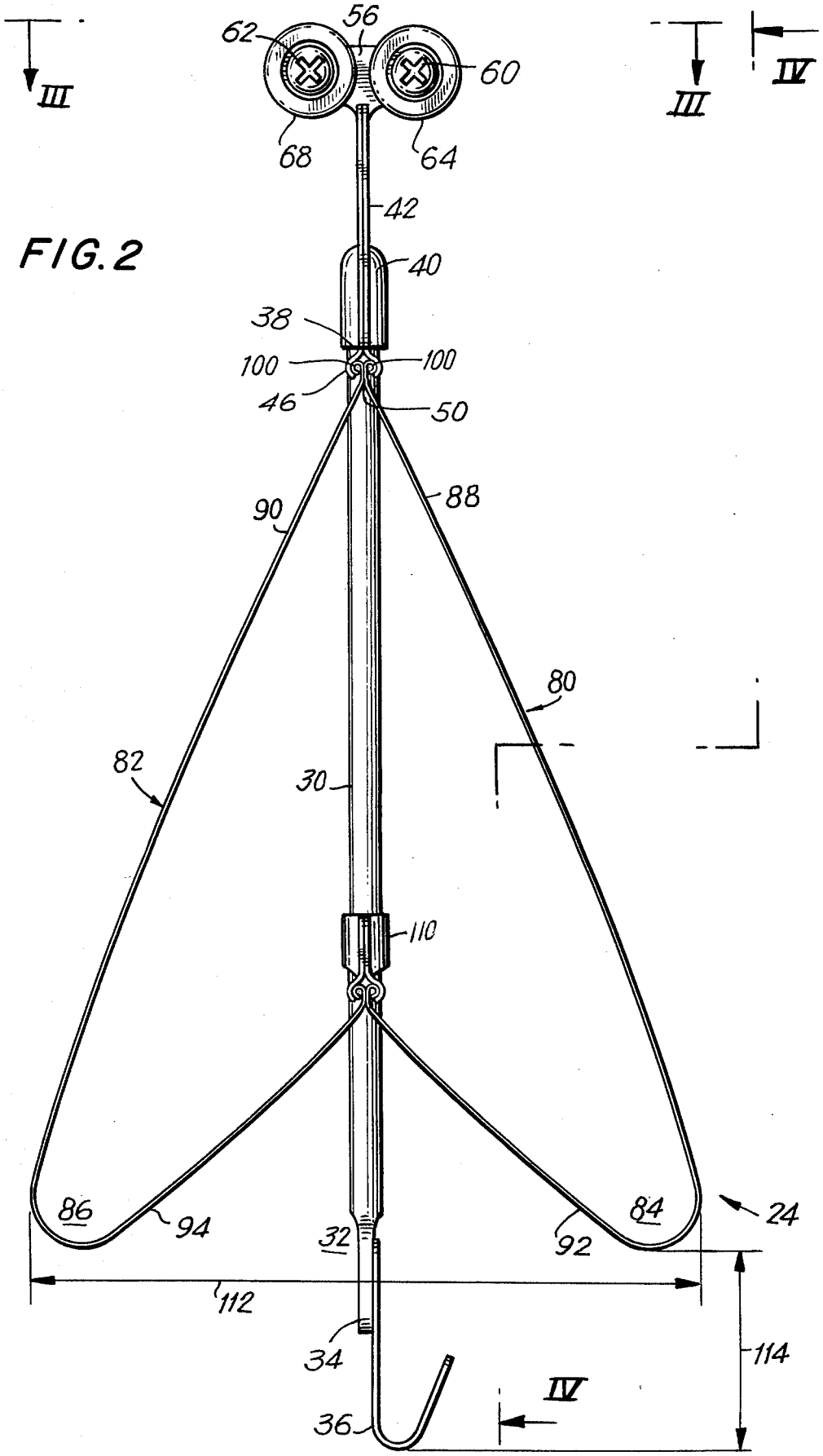
FIG. 2 is an elevational view of the floating hook arrangement of the present invention.
Figure 3:
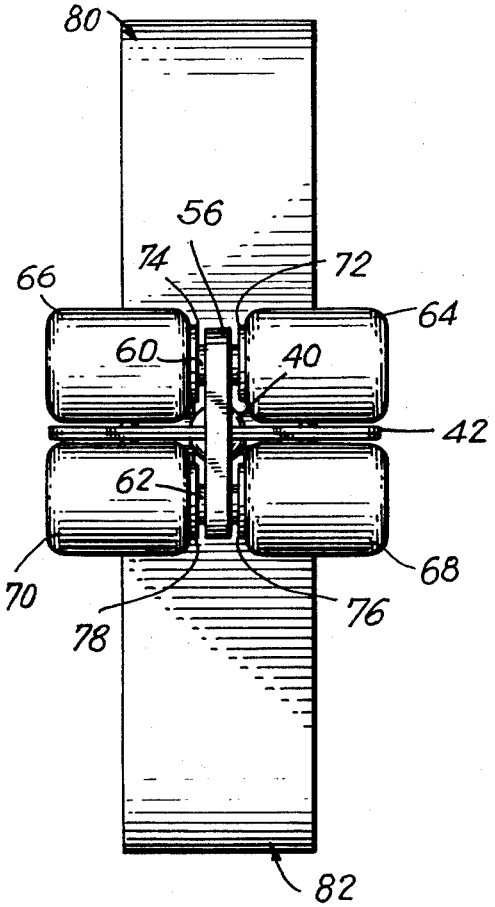
FIG. 3 is a plan view taken long line III—III of FIG. 2.
Figure 4:
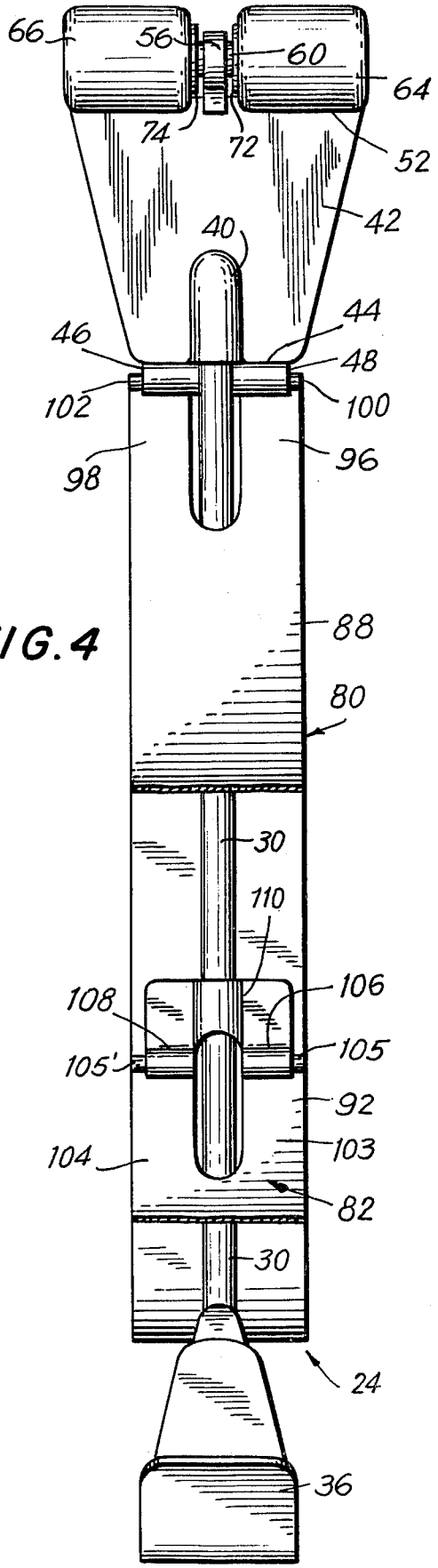
FIG. 4 is a side view, partially broken away and partially in section taken along line IV—IV of FIG. 1, showing the manner of supporting the ends of spreader elements of the floating hook arrangement of the present invention.

The floating hook arrangement 24 of the invention is best shown in FIG. 2–4. It has a central elongated shaft or support 30 which at its lower end 32 is formed into a flattened projection 34 which has mounted thereon, as by welding, a hook 36 from which a hanger supporting a garment to be bagged may be hung.

The other end 38 of the central shaft 30 is received in a sleeve or socket 40 formed integrally within a trapezoidal-shaped plate 42 which may be formed of two face-to-face sheets. The sleeve 40 protrudes outwardly from both outer faces of the plates 42 and is positioned centrally of the minor base 44 of the trapezoidal-shaped plate 42.

Extending downwardly from the minor base or lower edge 44 are a pair of hinge sockets 46 and 48 which form integral extensions of the plate 42. Each of the hinge sockets 46 and 48 is constituted by two semi-circular halves which define therebetween a lower central passageway or slot 50 by which rolled ends (to be described below) of the spreader units are enabled to extend into the hinge sockets. The hinge sockets 46 and 48 are coaxial and lie on diammetrically opposite positions relative to the end 38 of the central elongated shaft 30 and abut the shaft 30 with their ends adjacent thereto.

The major base, or upper edge, 52 of the plate 42 supports thereon a bracket 56 which extends transversely of the upper edge 52 at the center thereof. Bracket 56 has a pair of apertures (not shown) formed therein for the passage therethrough of a pair of roller pins 60 and 62 (see FIG. 3). Each roller pin rotatably supports two pairs of rollers 64 and 66 and 68 and 70. Washers 72, 74, 76 and 78 separate the ends of rollers nearest the bracket 56 from the bracket, and the other ends of the rollers are secured on the respective pins by any suitable means such as screws and washers.

The rollers 64, 66, 68, and 70 are freely rotatable about their respective pins and are preferably made of plastic with a low coefficient of friction, such as Teflon. The rollers 64, 66, 68 and 70 serve to support the floating hook arrangement of the invention in a floating manner from a support device having opposed rollers at its edges as disclosed in U.S. Pat. No. 3,961,460.

The floating hook arrangement as thus far described allows not only for an operator to swivel a garment hung therefrom and for passage of the bags to the garments, but also for the easy substitution and replacement of the hook arrangement.

The floating hook arrangement of the invention is further provided with a pair of spreader elements which form a generally heart-shaped spreader unit which straddles shaft 20 and which is compressible and serves to enter and spread the leading edge of each bag, as explained above. Each spreader element 80 and 82 is preferably made of resilient steel such as 0.006 inch thick, hard spring stainless-steel No. 301. The spring stainless steel of the spreader elements 80 and 82 is bent or curved to form apices 84 and 86 from which extend upper angled portions 88 and 90, and lower angled portions 92 and 94, respectively. The apices 84 and 86 are each rounded to a radius fo curvature of about one-quarter of an inch. The ends of each of the upper angled portions 88 and 90 are bifurcated to form extensions 96 and 98, the ends 100 and 112 of which are rolled or curled for reception on the hinge sockets 44 and 46. The extensions 96 and 98 of the upper angled portions are mounted in respective hinge sockets via the passageways 50 with the corresponding extension of each upper angled portion being mounted in the same hinge socket. that is, the extensions 96 of the upper angled portions 88 and 90 are positioned in the hinge socket 44, while the extensions 98 of the upper angled portions 88 and 90 are positioned in the hinge socket 46. The hinge sockets 44 and 46 are so dimensioned as to allow a limited amount of play for the ends 100 and 102 of the extensions 96 and 98 so that these ends are allowed to roll therein. Typically, the ends 100 and 102 of the extensions 96 and 98 may be allowed a roll of at least 5°. By way of example, the hinge sockets may be designed to be approximately one-sixteenth of an inch in diameter with each of the ends of the extensions being rolled to a diameter of approximately one thirty-second of an inch.

Each of the lower angled portions 92 and 94 is also formed with bifurcated extensions 103 and 104, each of which has rolled ends 105 and 105' which are similar in shape and dimension to the ends 100 and 102. The rolled ends 105 and 105' of the lower angled portions 92 and 94 are positioned within hinge sockets 106 and 108 which are similar in construction to hinge sockets 44 and 46. the hinge sockets 106 and 108 are integral part of a slide 110 which has a central aperture formed therein for the passage therethrough of the central shaft 30.

When the floating hook arrangement of the invention is mounted in the bagging apparatus, it is centrally located as previously described. After a garment is hung from the hook 36 by a hanger, a bag is pulled downwardly. This bag may have been previously opened or spread by the spreaders 18 and 20, if these are included in the apparatus and will then also be opened or spread by the spreader elements 80, 82.

As one bag is pulled over a garment, the spreaders 18 and 20, if used, and the spreader elements 80, 82 will exit from the trailing end of the bag via the openings in the seams mentioned above. As one bag is pulled completely down over the garment, the next sequential bag may be locked in position by the sensing and braking arrangements disclosed in U.S. Pat. No. 3,961,460 thereby providing for automatic or simi-automatic detachment of the leading bag. When such movement is breaked as mentioned above, the spreaders 18 and 20 (if used) and the spreader elements 80 and 82 have already passed through the openings in the seams and have entered into the leading end of the next bag thereby to spread open the same for subsequent pulling over another garment.

Prior to the pulling of a bag over a garment, the unbiased or neutral span of the spreader elements as indicated at 112 is greater than the opening in the seams provided to enable the passage of the floating hook arrangement. Upon the pulling down of the bag over the garment, the spreader elements 80 and 82 will be forced inwardly so that the slide 110 will be forced upwardly along the central shaft 30. At the same time, this will cause the rolled ends 100 and 102 and 105 and 105' to roll in their respective hinge sockets so that the combination of rotating ends and sliding will cause the stressing of the spreader elements to be somewhat less than would otherwise be the case. This results in a longer lasting floating hook arrangement.

In order to prevent the seams in the trailing end of the bag from contacting the garment before the forward movement thereof is stopped and the leading bag torn from the continuous supply of bags, it is necessary to make the length as indicated at 114 sufficiently long that the spreader elements 82 and 80 will have already entered into the leading end of the next bag before the sensing device causes the braking device to operate.

While the floating hook arrangement of the invention has been shown and described in particular form and reference to a particular apparatus for bagging garments, it is to be understood that it has utility in different form and in apparatus different from that shown.

In general the invention may be regarded as providing an apparatus comprising a first means for engaging a unit to be processed. The unit to be processed is indicated, for example, at 22 in FIG. 1 and the first means may be regarded as including the hook 36 at the bottom of the arrangements 24 provided in accordance with the invention. There is also provided a support which may be considered as including elements 56, 64, 66, 68 and 70 although not being limited thereto. A second means connects the first means to the support and is constituted by way of example by elongated member 30. The first means and second means are in generally longitudinal alignment and have respective maximum transverse dimensions relative to this alignment. A compressible means is provided in accordance with the invention including but not limited to elements 80 and 82 as well as the slide and other supporting elements associated therewith. The outer transverse dimension of the compressible means is indicated in 112 and this exceeds the respective maximum transverse dimensions of the first means and second means as well as the support. In accordance with the invention, the compressible means 80 and 82 enables passage through a restricted opening such as is provided in the bag to be applied to a garment. The compressible means in normal expanded state is adapted to perform a spreading function relative to such bag.

The compressible means extends outwardly from opposite sides of the second means in the illustrated embodiment but it would be possible, under certain circumstances, for the spreading means to be spread outwardly at an angle from the second means as well as to extend outwardly from a single side of the latter.

There will now be obvious to those skilled in the art many modifications and variations of the structures set forth here and above. These variations and modifications will not depart from the scope of the invention if defined by the following claims.

What is claimed is:

1. A floating hook arrangement for use in an apparatus for bagging garments, said apparatus having means for supporting said floating hook arrangement, said arrangement comprising a central elongated shaft having a first end and a second end spaced from said first end; a hook mounted on said central elongated shaft at said first end for supporting a garment thereon; means at said second end for mounting said central elongated shaft on said means for supporting said floating hook arrangement; and a spreader unit on said shaft and having a first end adjacent said means for mounting said central shaft, and a second end spaced from the latter said first end toward said first end of said central elongated shaft and engaged with said central elongated shaft.

2. A floating hook arrangement as claimed in claim 1, wherein said first end of said spreader unit is connected to said means for mounting said central elongated shaft on said means for supporting said floating hook arrangement, said means for mounting said central elongated shaft comprising a hinge socket for the reception therein of said first end of said spreader unit.

3. The floating hook arrangement as claimed in claim 2 comprising means for mounting said second end of said spreader unit on said shaft and including a hinge socket for reception therein fo said second end of said spreader unit.

4. The floating hook arrangement as claimed in claim 1, wherein said spreader unit comprises a first spreader element and a second spreader element, each of said first and second spreader elements having an upper angled portion and a lower angled portion, said upper and lower angled portions of each of said first and second spreader elements being of spring metal.

5. The floating hook arrangement as claimed in claim 4, wherein each of said upper and lower angled portions comprises a rounded end, the rounded ends of said upper angled portions constituting said first end of said spreader unit, and said rounded ends of said lower angled portions constituting said second end of said spreader unit.

6. The floating hook arrangement as claimed in claim 5, wherein each of the rounded ends of said upper and lower angled portions are bifurcated.

7. The floating hook arrangement as claimed in claim 6, wherein said means mounted at said second end for mounting said elongated shaft comprises a first hinge socket and a second hinge socket extending downwardly from a said second end of said central elongated shaft toward said first end of said elongated shaft, each of said bifurcated rounded ends of said upper angled portions having a first extension and a second extension, said first extension of each upper angled portion being mounted in said first hinge socket and said second extension of each upper angled portion being mounted in said second hinge socket, whereby said rounded ends are allowed to partially turn in said hinge socket.

8. The floating hook arrangement as claimed in claim 6, wherein said means for connecting said second end of said spreader unit to said central elongated shaft comprises a first hinge socket and a second hinge socket extending downwardly toward said first end of said central elongated shaft, each of said bifurcated rounded ends of said lower angled portions having a first extension and a second extension, said first extension of each lower angled portion being mounted in said first hinge socket and said second extension of each lower angled portion being mounted in said second hinge socket, whereby said rounded ends are allowed to partially turn in said hinge sockets.

9. The floating hook arrangement as claimed in claim 3, wherein said means for connecting said second end of siad spreader unit to said central elongated shaft comprises a slide having an aperture formed therein for the passage therethrough of said central elongated shaft, said slide travelling up and down said central elongated shaft in response to forces exerted on said spreader unit by a plastic bag.

10. The floating hook arrangement as claimed in claim 1, wherein said means for mounting said central elongated shaft on said means for supporting said floating hook arrangement comprises a support extending upwardly from said second end of said central elongated shaft, a bracket mounted on said support, a plurality of rollers, and means on said bracket rotatably mounting said plurality of rollers thereon.

11. The floating hook arrangement as claimed in claim 10, wherein said support is a flat plate which comprises a sleeve, said sleeve receiving therein said second end of said central elongated shaft.

12. An apparatus for bagging garments comprising said floating hook arrangements as claimed in claim 1, siad apparatus further comprising a supply of plastic flatted tubing formed as a series of bags for covering garments, and a dispensing section for separating said bags from one another for placement over garments hung at said dispensing section, said dispensing section including said means for mounting said floating hook arrangement.

13. A floating hook arrangement as claimed in claim 1 wherein said spreader unit is a generally heart-shaped compressible unit of spring metal strip straddling said shaft.

* * * * *